United States Patent [19]

Kazokas, Jr.

[11] Patent Number: 4,934,871

[45] Date of Patent: Jun. 19, 1990

[54] OFFSHORE WELL SUPPORT SYSTEM

[75] Inventor: William C. Kazokas, Jr., Mesquite, Tex.

[73] Assignee: Atlantic Richfield Company, Los Angeles, Calif.

[21] Appl. No.: 423,498

[22] Filed: Oct. 12, 1989

Related U.S. Application Data

[63] Continuation of Ser. No. 286,598, Dec. 19, 1988, abandoned.

[51] Int. Cl.[5] ..... E02D 5/54

[52] U.S. Cl. ..... 405/224; 405/195; 166/335; 166/350

[58] Field of Search ..... 405/195, 202, 224; 166/355, 364, 359, 367, 335, 350, 367, 368

[56] References Cited

U.S. PATENT DOCUMENTS

| | | | |
|---|---|---|---|
| 4,110,628 | 8/1978 | Paull et al. | 166/335 X |
| 4,273,470 | 6/1981 | Blomsma et al. | 405/202 |
| 4,511,287 | 4/1985 | Horton | 405/195 X |
| 4,662,785 | 5/1987 | Gibb et al. | 166/359 X |
| 4,702,321 | 10/1987 | Horton | 405/224 X |
| 4,712,620 | 12/1987 | Lim et al. | 405/195 X |
| 4,730,677 | 3/1988 | Pearce et al. | 405/195 X |
| 4,768,984 | 9/1988 | de Oliveira et al. | 405/195 X |

*Primary Examiner*—Dennis L. Taylor
*Assistant Examiner*—Arlen L. Olsen
*Attorney, Agent, or Firm*—Michael E. Martin

[57] ABSTRACT

An offshore subsea well includes a wellhead to which is connected an elongated somewhat flexible riser extending to the sea surface. The riser pipe is unstayed and is buoyed at least partially by a buoyancy member connected to the riser between the sea surface and the wellhead. Flow control valves and well access components are disposed at the upper end of the riser pipe and extend only a few feet above the sea surface during a normal or calm sea condition. A production fluid flowline returns to the sea floor alongisde the riser for extension to a central platform for the reservoir. The well support system provides for a low cost surface disposed Christmas tree arrangement which does not require a fixed support platform. The buoyancy member is preferably an annular can which is connected to an upper end of an elastically bendable section of the riser and which supports a tower for a work platform and hazards to navigation aids.

5 Claims, 2 Drawing Sheets

OFFSHORE WELL SUPPORT SYSTEM

This application is a continuation of application Ser. No. 286,598, filed Dec. 19, 1988, now abandoned.

BACKGROUND OF THE INVENTION

Field of the Invention

The present invention pertains to an offshore or submarine oil and gas well support having a wellhead at the sea floor to which is connected an elongated riser which is supported by a buoyant tower having a superstructure extending slightly above the surface of the sea and disposed around the well flow control valves and associated components.

The development of offshore wells for hydrocarbon reservoirs and the like is complicated by the cost of providing and maintaining a total subsea completion system including the wellhead and the associated control valves and related components making up what is sometimes known as the Christmas tree. Although high production wells in moderate depths of from 300 to 800 feet may justify the expense of total subsea completion systems, the expense and hazards associated with servicing these wells is also an important consideration.

Alternatively, particularly in shallow waters, single well completion systems usually include a fixed support structure resting on or anchored to the seabed and supporting above the surface the wellhead and the well flow control and servicing components. However, for relatively low production wells the cost of the support structure may not justify completion of the well. Accordingly, there has been a need for an offshore well support system, particularly adapted for single wells, which can be considered for wells of a wide range of productive capacity, but which can more easily justify the completion of and production from wells which would otherwise not be considered. In particular, there is a need for a cost effective well support and production system for wells in depths greater than about 300 feet.

Certain considerations for relatively low production wells or reservoirs include the ease of installation of the well support structure, its ability to accommodate various sea states and the ease of access to wellhead flow control and flow monitoring components for servicing and workover of the well. In this latter regard, it has been considered important to provide a support structure which supports the Christmas tree only slightly above the sea surface so that a conventional workboat may be used for minor maintenance and wireline operations and certain types of floating drilling rigs, such as semi-submersible rigs, may be moved into position over the well while operating at their transit depth without disassembling major components of the well support structure. These problems and desiderata associated with the development and construction of certain offshore well support systems have been solved and satisfied, respectively, by the present invention.

SUMMARY OF THE INVENTION

The present invention provides a unique support system for a single offshore submarine well wherein a conventional wellhead is put in place on the sea floor and is connected to an elongated riser extending toward the sea surface and supported near its upper end by a buoyancy member which also supports a platform disposed adjacent the well flow control components and the point of access for certain servicing operations in an assembly otherwise known as the Christmas tree.

In accordance with an important aspect of the present invention, a subsea well support structure is provided wherein the wellhead Christmas tree or flow control components are supported above the sea surface, but on a structure having relatively low freeboard whereby conventional workboats and semi-submersible drilling rigs may be moved into working positions and anchored without disassembling any portion of the well. In particular, many semi-submersible drilling rigs may be moved into position for working over the well while operating at their normal transit depth.

In accordance with another aspect of the present invention, there is provided a single well support structure for a subsea well wherein an unstayed riser is connected to a subsea wellhead and to a support platform for wellhead components. The riser is preferably buoyed by a suitable buoyancy member or members connected to the riser at a modest depth. The buoyancy member is also adapted to support a tower for a work platform at which the well flow control components or Christmas tree are disposed. The arrangement of a subsea wellhead together with an unstayed riser having suitable buoyancy means connected thereto for supporting a low freeboard platform and Christmas tree structure above the sea surface which is free to undergo excursion in response to all sea conditions, provides a modest cost and superior well support structure which provides easy access to wells in moderate as well as even greater depths for servicing and workover operations. Conventional wellhead components may be used above the sea surface which may be manually controlled for well servicing and workover operations and remotely controlled for continuous well functions. Complicated and expensive support structures are eliminated as well as more complicated subsea well operating components, thus lower production rate or smaller reservoirs may be developed which have heretofore been uneconomical to produce.

The advantages and superior features of the present invention described herein as well as other aspects thereof will be further appreciated by those skilled in the art upon reading the detailed description which follows.

DESCRIPTION OF PREFERRED EMBODIMENTS

Figure 1:
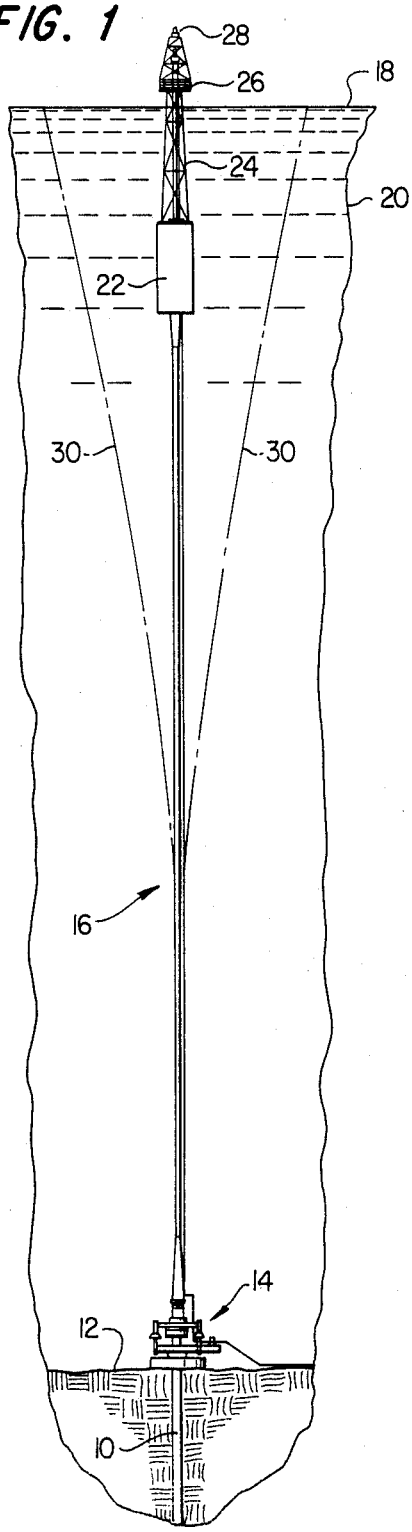
FIG. 1 is a vertical section view in somewhat schematic form of a subsea or offshore well support system in accordance with the present invention.

In the description which follows like parts are marked throughout the specification and drawing with the same reference numerals, respectively. The drawing figures are not necessarily to scale and certain features of the invention have been shown exaggerated in scale or in somewhat schematic form in the interest of clarity and conciseness. Conventional elements commercially available are described in some instances in general terms only.

Referring to FIG. 1, there is illustrated a subsea well 10 which has been drilled into a seabed 12. The well 10 includes a seabed wellhead assembly and support means generally designated by the numeral 14 to which is connected an elongated riser 16. The riser 16 extends toward the surface 18 of the sea 20 and is connected to a buoyancy member 22 which preferably comprises one or more generally annular can-like structures having one or more suitable buoyancy chambers formed therein. The buoyancy member 22 supports a tower 24 which includes a small work platform 26 disposed around an assembly of flow control valves and other components for gaining access to the wellbore, sometimes known as the Christmas tree. The well support system also includes suitable navigation aids such as a marker beacon and/or radar target, for example, generally designated by the numeral 28.

The portion of the tower 24 which extends above the sea surface 18 during calm sea conditions preferably does not exceed a height, or an amount of freeboard, greater than about four to six feet. As indicated in FIG. 1, the flexibility of the riser assembly 16 allows excursion of the riser and the components connected thereto in response to varying sea conditions within an envelope indicated by the numeral 30. It is contemplated that the well support system including the portion of the tower 24 extending above the sea surface would be adapted for complete submersion in the most severe sea states. The low freeboard of the portion of the tower 24 extending above the surface 18 permits access to the platform 26 and the well 12 with equipment on a conventional offshore workboat, not shown, for routine inspection, maintenance and wireline operations, for example. More substantial well workover operations such as replacement of tubing strings or redrilling may be accomplished with a conventional semi-submersible drilling rig, many of which may pass over and center themselves on the well while operating at transit depth.

For example, conventional semi-submersible drilling rigs are equipped with spaced apart submersible hulls or pontoons from which extend vertical column members and transverse brace members. A substantial number of the semi-submersible drilling rigs operating prior to the development of the present invention are capable, when deballasted to their transit depth, of clearing objects extending from the sea surface up to as much as ten feet. Accordingly, by providing the well support system of the present invention to extend above the sea surface during calm sea conditions no more than four to six feet, conventional floating service and maintenance vessels may gain access to the well without disassembly of the well support system from the subsea wellhead structure.

Figure 2:
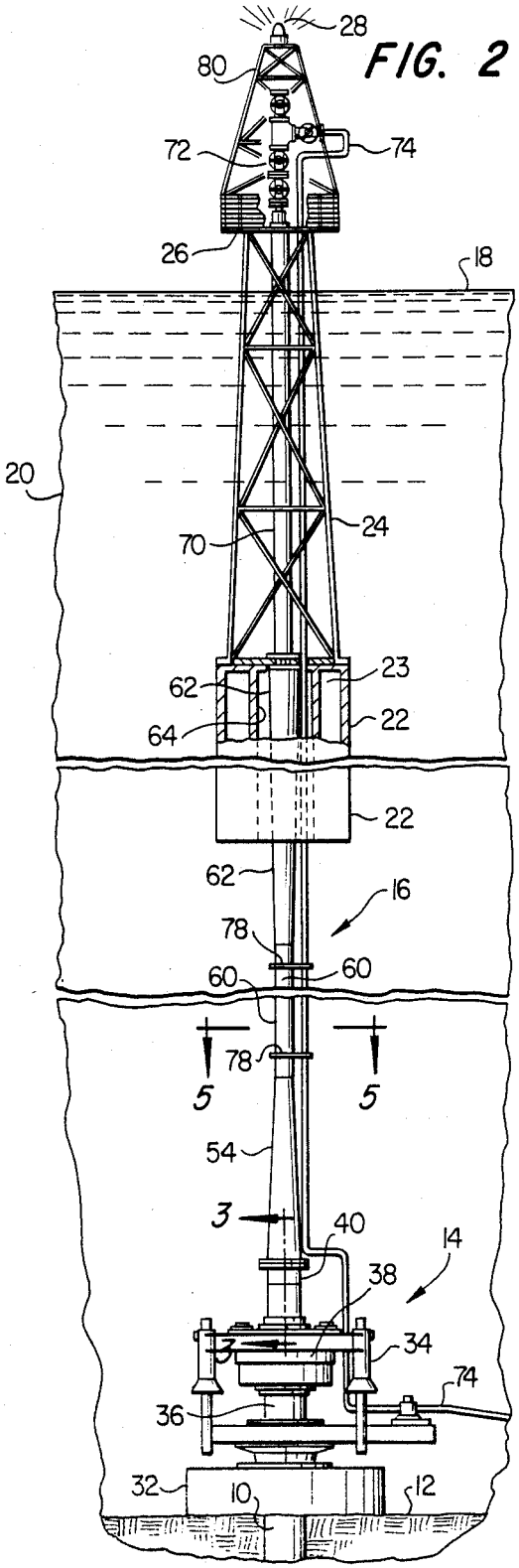
FIG. 2 is a view similar to FIG. 1 on a larger scale showing detail of the subsea wellhead and the surface support-structure.
Figure 3:
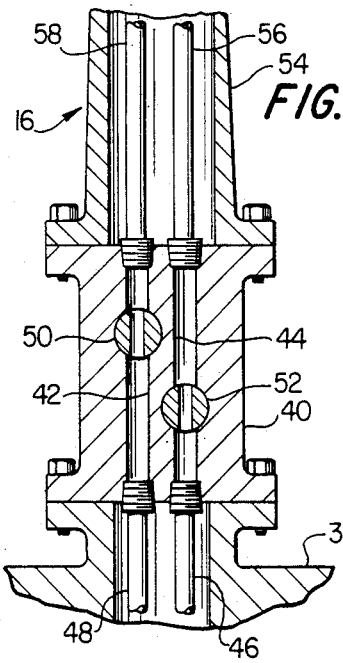
FIG. 3 is a section view taken along the line 3—3 of FIG. 2.

Referring now to FIG. 2, the well 10 is shown as being completed through a conventional subsea template 32 which supports a guide base assembly 34, also of conventional construction. The well 1? includes a conventional subsea wellhead 36 to which is connected a wellhead connector assembly 38, also of the type commercially available. The template or temporary guide base 32, the guide base assembly 34, the wellhead 36 and the wellhead connector 38 may be of a type commercially available from Cameron Iron Works, Inc., Houston, Texas.

Figure 5:
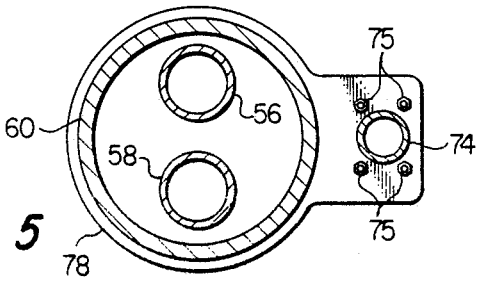
FIG. 5 is a detail section view taken generally along the line 5—5 of FIG. 2.

In one preferred form of construction of the wellhead support system of the present invention a flanged valve "block" or support member 40 is connected to the wellhead connector 38, see FIG. 5 also, and includes suitable internal passages 42 and 44, for example, for the passage of fluids between the wellbore and the riser assembly 16. Conventional tubing strings 46 and 48 are connected to the valve support member 40 and suitable remote controlled valves 50 and 52 are interposed in the passages 42 and 44 for controlling the flow of fluids between the well 10 and the riser 16.

The riser 16 preferably includes at least one elongated, generally cylindrical tapered section 54 suitably secured to and extending generally vertically from the valve block or support member 40. The tapered section 54 is adapted to distribute the bending stresses on the riser assembly 16 substantially evenly along the riser section 54 in response to bending loads on the riser assembly. Suitable tubing strings 56 and 58 which are connected to the valve support member 40 by conventional means extend upward within the riser assembly 16 from the valve support member for conducting fluids to and from the tubing strings 46 and 48, for example.

The riser assembly 16 also includes a generally cylindrical section 60 extending toward the buoyancy member 22. The cylindrical section 60 is connected to a second tapered section 62 of the riser assembly 16 which preferably extends within a central passage 64, see FIG. 4 also, formed in the annular buoyancy member 22. The tapered section 62 tapers outwardly to a flanged connection with a support member 66 secured to or forming an integral part of the buoyancy member 22. The buoyancy member 22 may comprise a generally cylindrical "can" having one or more annular buoyancy chambers 23 formed therein. The buoyancy member 22 is suitably sized to provide sufficient buoyancy to minimize any compression loads on the riser assembly 16 and to support the tower 24. The buoyancy member may also be constructed in modular sections and be of a tapered configuration, at least in part.

A further riser member 70 is secured to the support member 66 in alignment with the riser assembly 16 and extends to the platform 26. A conventional assembly of flow control valves or Christmas tree 72 is mounted on the upper end of the riser pipe 70 and is suitably connected to the tubing strings 56 and 58 in a conventional manner known to those skilled in the art for controlling the flow of fluids to and from the wellbore of the well 10. A production fluid flowline 74 is suitably connected to the Christmas tree 72, extends down through the platform 26 and alongside the riser pipe 70 and the riser assembly 16 to the subsea wellhead assembly 14 and then extends to suitable means for receiving the production flow such as a central platform, not shown, for treatment of the production fluid and conveyance to suitable storage means, also not shown. The production flowline 74 together with any hydraulic control lines associated with the Christmas tree 72, such as the control lines 75 shown in FIG. 5, are preferably trained alongside the riser assembly 16 by suitable guide and support brackets 78, one shown in FIG. 5.

Figure 4:
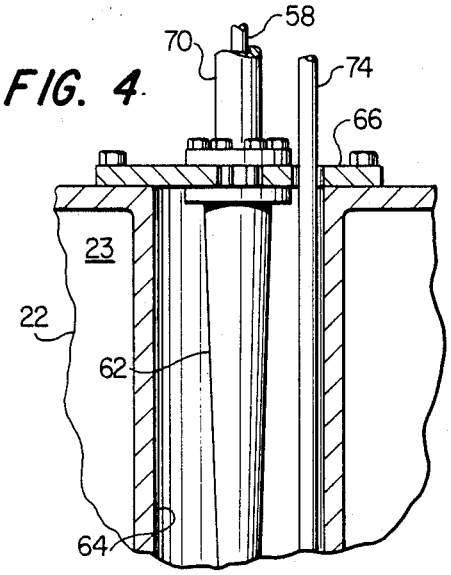
FIG. 4 is a detail view of the connection between the riser assembly and the buoyancy member of the well support system.

The production flowline 74 and the control lines 75 are exemplary and those skilled in the art will recognize that multiple flowlines and additional control lines may be trained alongside the riser assembly 16 leading to and from the aforementioned platform. As illustrated in FIG. 4, the flowline 74 and the respective control lines 75 are also preferably trained through the passage 64 in the buoyancy member 22. Alternatively, a production fluid flowline may be returned to the seabed contained within the riser pipe 70 and the remainder of the riser assembly 16 and exit the wellhead assembly 14 at the valve housing member 40, for example. This arrangement would provide additional protection for the production flowline and certain ones of the control lines, if desired.

As illustrated in FIG. 2, the platform 26 also supports a suitable removable tower section 80 which includes the navigation beacon 28 and any other associated navigation aids required for the tower 24. The tower section 80 may be suitably connected to the platform 26 in a way which permits easy removal so that access to the Christmas tree 72 for workboat based operations may be easily carried out or, in the event of major workover activity, access to the tubing strings may be obtained with a semi-submersible drilling rig or the like. In some instances, it may be preferable to extend the riser pipe 70 and the Christmas tree 72 to a point essentially at the sea surface 18 or slightly below so that only the navigation aid tower 80 extends above the sea surface during normal sea conditions. This arrangement would further lower the clearance requirements for a vessel positioning itself over the well support system for whatever operations might be required.

Figure 6:
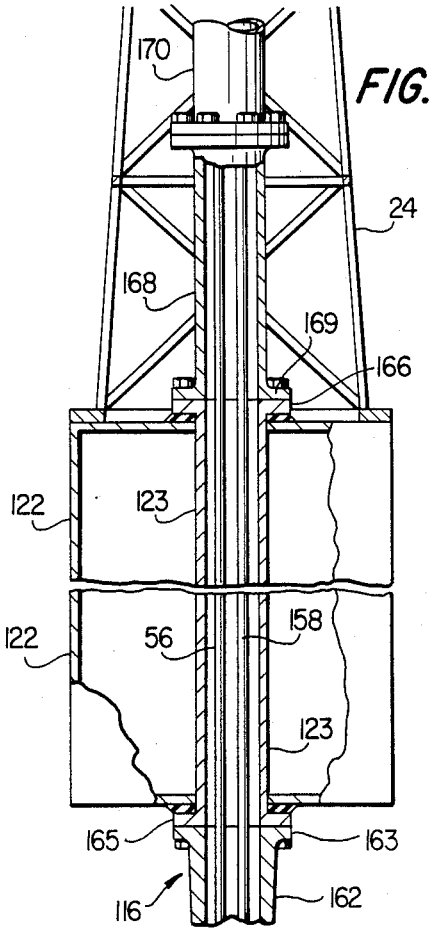
FIG. 6 is a detail section view of a modified connection between the riser assembly and the buoyancy member.
Figure 7:
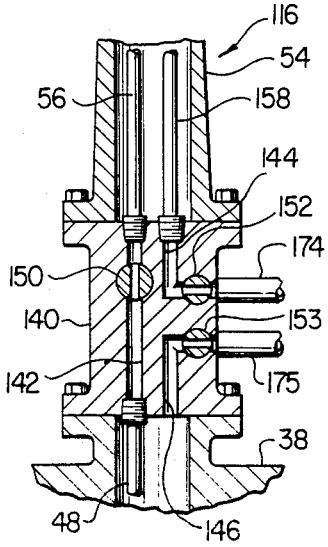
FIG. 7 is a detail section view of a modified valve block.

Referring now to FIGS. 6 and 7, there is illustrated a modification of an offshore well support system in accordance with the present invention wherein a modified riser assembly and buoyancy member are provided as illustrated in FIG. 6 and a modified valve block or support member for connection to the wellhead connector is illustrated in FIG. 7. The modified well support system illustrated in FIGS. 6 and 7 includes a riser assembly 116 having a lower riser member 54, FIG. 7, connected to a modified valve block 140. However, in the riser assembly 116 the riser pipe 62 of the riser assembly in accordance with the embodiment of FIG. 2 is replaced by a riser pipe 162 having a tapered portion adjacent a transverse upper end flange 163. A modified buoyancy member 122 of generally annular configuration is formed integral with a riser pipe section 123 having a lower transverse flange 165 for connecting the riser pipe section 123 and buoyancy member 122 to the riser pipe section 162. The riser pipe section 123 has an upper transverse flange 166 for connecting the riser pipe section and the buoyancy member to a riser pipe section 168 having a transverse flange 169. The riser pipe section 168 is connected to a modified upper riser pipe section 170 which extends through the tower 24 to a platform 26, not shown in FIG. 6, in the same manner as the arrangement of FIG. 2.

In the system modification as illustrated in FIGS. 6 and 7, the production fluid conduit 56 extends from the modified valve block 140 through the riser assembly 116 to the Christmas tree or valve manifold 72 and a production fluid conduit 158 also extends within the riser assembly 116 from the Christmas tree 72 to the valve block 140. In the modified system illustrated in FIGS. 6 and 7 the conduit 158 serves to return production fluid to a point adjacent the seabed within the riser pipe assembly 116. The conduit 158 is in communication with a production fluid conduit 174 through a passage 144 and a flow control valve 152 in the valve block 140, FIG. 7.

Referring further to FIG. 7, the valve block 140 includes a production fluid passage 142 and a shutoff valve 150 interposed therein and a passage 146 adapted to be in communication with the well annulus through the wellhead connector 38. A shutoff or flow control valve 153 is interposed in the passage 146 for controlling the flow of fluid between the annulus and a conduit 175. In the system as modified by FIGS. 6 and 7, all flow lines between the wellhead 14 and the Christmas tree 72 may be extended through the riser assembly 116, a more distributed load between the buoyancy member 122 and the riser assembly 116 may be obtained and additional flow control may be carried out at the valve block 140 connected to the wellhead connector 38.

The materials and components used in constructing the well support system described hereinabove may be those which are familiar to the art worker in marine or offshore well completion and production equipment. The method of installation of the well support system described herein may also be carried out using conventional practice in the offshore well installation and operation industry. As pointed out hereinabove, the well support system described is particularly advantageous for well completions and production of fluids from single subsea wells in relatively small or marginal oil or gas reservoirs. Thanks to the arrangement of the unstayed riser assembly which is supported by a buoyancy member and a low rise or minimum freeboard surface structure, installation of the well production equipment and access to the well for control, maintenance or inspection operations is particularly enhanced.

Although preferred embodiments of the present invention have been described in detail herein, those skilled in the art will recognize that various substitutions and modifications may be made to the system disclosed without departing from the scope and spirit of the invention as recited in the appended claims.

What is claimed is:

1. A support system for an offshore well extending into a reservoir below a seabed, said well having wellhead means disposed at the seafloor, said system comprising:

a single elongated unstayed tubular riser connected at one end to means for interconnecting said riser with said wellhead means, said riser having a first flexible portion connected to said means for interconnecting and extending toward the sea surface and a second portion of said riser connected to said first portion and extending above the sea surface;

said means for interconnecting includes passage means for conducting fluids therethrough and valve means interposed in said passage means for controlling the flow of fluid between said riser and said wellhead;

a flow control valve assembly supported by an end of said second portion of said riser which extends above said sea surface;

a submerged buoyancy member connected to said riser at a point below the sea surface for supporting at least some of the weight of said riser and said valve assembly;

first tubing means connected to said means for interconnecting and to said valve assembly and extending within said riser for conducting production fluid between said wellhead means and said valve assembly;

second tubing means extending between said valve assembly and said means for interconnecting for conducting production fluid from said valve assembly to a production fluid conduit extending from said system at said seafloor; and said riser is supported with respect to said seabed at said one end of said riser and otherwise only by said submerged buoyancy member such that said buoyancy member and said riser are responsive to wave action of the sea to permit lateral excursion of said valve assembly, said buoyancy member and at least a portion of said riser above said one end with respect to said wellhead means without discontinuing the flow of fluids through said tubing means.

2. The system set forth in claim 1 wherein:

said tubing means includes a dual tubing string extending within said riser between said means for interconnecting and said valve assembly, and said means for interconnecting includes valve means therein and passage means for conducting production fluid to said production fluid conduit extending from said system at said seafloor and by way of said dual tubing string.

3. The system set forth in claim 1 including:

a support tower disposed on said buoyancy member and extending above the sea surface, said tower including platform means thereon disposed adjacent to said valve assembly.

4. The system set forth in claim 1 wherein:

said buoyancy member comprises a generally annular member secured to said riser at an upper end of said buoyancy member, said buoyancy member having passage means therein for extension of said riser through said buoyancy member.

5. The system set forth in claim 1 wherein:

said buoyancy member comprises a generally annular member including an integral riser section secured thereto and forming a part thereof, said riser section having means for connecting said buoyancy member to said first portion of said riser and said second portion of said riser to thereby become a part of said riser.

* * * * *